US005433632A

United States Patent [19]

Cherney et al.

[11] Patent Number: 5,433,632

[45] Date of Patent: Jul. 18, 1995

[54] FLEXIBLE CIRCUIT CONNECTOR

[75] Inventors: Thomas Cherney, Georgetown, Tex.; Rolf Biernath, Roseville, Minn.

[73] Assignee: Minnesota Mining and Manufacturing Company, St. Paul, Minn.

[21] Appl. No.: 289,651

[22] Filed: Aug. 12, 1994

Related U.S. Application Data

[63] Continuation of Ser. No. 11,199, Jan. 29, 1993, abandoned.

[51] Int. Cl.[6] ..... H01R 9/07

[52] U.S. Cl. ..... 439/495

[58] Field of Search ..... 439/492–499, 439/76–77

[56] References Cited

U.S. PATENT DOCUMENTS

| | | |
|---|---|---|
| 2,932,810 | 5/1952 | Novak . |
| 2,961,629 | 2/1957 | Kamm . |
| 3,114,587 | 10/1961 | Hermann . |
| 3,141,720 | 9/1961 | Johnson . |
| 3,284,756 | 11/1966 | Vanstrom . |
| 3,489,990 | 1/1970 | Parker et al. . |
| 3,772,776 | 11/1973 | Weisenburger . |
| 3,825,878 | 7/1974 | Finger et al. . |
| 3,924,915 | 12/1975 | Conrad . |
| 4,057,311 | 11/1977 | Evans . |
| 4,116,516 | 9/1978 | Griffin . |
| 4,203,203 | 5/1980 | Gilissen et al. . |
| 4,517,625 | 5/1985 | Frink et al. . |
| 4,581,495 | 4/1986 | Geri et al. . |
| 4,645,732 | 2/1987 | Young . |
| 4,691,972 | 9/1987 | Gordon . |
| 4,693,529 | 9/1987 | Stillie . |
| 4,717,345 | 1/1988 | Gordon et al. . |
| 4,740,867 | 4/1988 | Roberts et al. . |
| 4,784,615 | 11/1988 | Teng-Hong . |
| 4,798,541 | 1/1989 | Porter . |
| 4,815,979 | 3/1989 | Porter . |
| 4,815,990 | 3/1989 | Ristedt et al. . |
| 4,889,498 | 12/1989 | Mizuta . |
| 4,897,054 | 1/1990 | Gilissen et al. . |
| 4,971,565 | 11/1990 | Fox, Jr. . |
| 4,971,575 | 11/1990 | Martellotti . |
| 5,002,496 | 3/1991 | Fox, Jr. . |
| 5,009,607 | 4/1991 | Gordon et al. . |
| 5,040,997 | 8/1991 | Garner . |
| 5,044,980 | 9/1991 | Krumme et al. . |
| 5,076,803 | 12/1991 | Mutarelli et al. . |
| 5,092,782 | 3/1992 | Beaman . |
| 5,133,667 | 7/1992 | Daughtrey . |
| 5,141,444 | 8/1992 | Redmond et al. . |
| 5,153,818 | 10/1992 | Mukougawa et al. . |

FOREIGN PATENT DOCUMENTS

| | | |
|---|---|---|
| 0239422 | 9/1987 | European Pat. Off. . |
| 2513635 | 10/1975 | Germany . |
| 2836026 | 2/1980 | Germany . |
| 55-64284 | 5/1980 | Japan . |
| 56-59774 | of 1981 | Japan . |
| 58-96686 | 6/1983 | Japan . |
| 60-92866 | 6/1985 | Japan . |
| 229670 | 9/1985 | Japan . |
| 4-368787 | 12/1992 | Japan . |
| 1472688 | 3/1974 | United Kingdom . |
| 1522029 | 9/1976 | United Kingdom . |
| 2069249 | 8/1981 | United Kingdom . |

OTHER PUBLICATIONS

IBM Technical Disclosure Bulletin, vol. 28, No. 11, Apr. 1986, pp. 4989–4990, "Cable Connector".

*Primary Examiner*—Khiem Nguyen

*Attorney, Agent, or Firm*—Gary L. Griswold; Walter N. Kirn; Eric D. Levinson

[57] ABSTRACT

A flexible circuit connector for electrically connecting two electronic devices. The connector includes a flexible circuit sheet having electrically conductive traces which lead from a first electronic device, such as a memory chip, to two arrays of electrically conductive pads. The connector includes a connector housing having two spaced, substantially parallel side walls connected by a front wall having a row of holes adjacent each of the side walls to receive two rows of conductive pins which are connected to a second electronic device, such as a printed circuit board. A unitary, locally deformable, biasing member is positioned within the connector housing and between the two array of conductive pads. The biasing member forces the two arrays of pads into electrical contact with the two rows of pins when the pins are inserted into the holes in the front wall of the connector housing.

31 Claims, 4 Drawing Sheets

FLEXIBLE CIRCUIT CONNECTOR

This is a continuation of application No. 08/011,199 filed Jan. 29, 1993, now abandoned.

FIELD OF THE INVENTION

The invention relates generally to connectors for connecting electronic devices, and more particularly to connectors which include a flexible circuit.

BACKGROUND OF THE INVENTION

It is well known that two electronic devices can be connected by providing one of them with several pins and the other with sockets for receiving those pins. Stamped metal springs are typically used to ensure that good electrical contact is maintained between the pins and the sockets. Usually, one spring is provided for each pin.

The use of these stamped metal springs, however, becomes increasingly expensive as the number of pins increases. The number of pins, and therefore the number of springs required, typically ranges between a few and 68, but may extend into the hundreds. Thus, while it may sometimes be advantageous to decrease the size of the pins or the spacing between them, this reduction can be complicated by the difficulty and cost of manufacturing and installing so many tiny springs, each of which must still be strong enough to ensure good electrical contact between the pins and their respective sockets.

Integrated circuit (IC) cards are increasingly being used with portable computers. Integrated circuit cards include personal computer (PC) cards and Smart cards. There are two basic types of PC cards: input/output (I/O) cards and memory cards. Memory cards are used to store data in portable electronic devices, such as portable computers. Memory cards can be used to increase the core memory of a computer, or they can be used to store information pertaining to one particular subject, e.g., they can be used in a hospital setting to store a patient's medical records. Memory cards typically include at least one integrated circuit (IC) chip having either read-only-memory (ROM) or random-access-memory (RAM). The chief advantage of such cards is that they can be easily inserted and removed from the electronic device by the use of a multi-pin connector of the type described above. Such IC chips are commonly known as memory chips.

In order to be useful, the card connector must be able to withstand many insertion and withdrawal cycles. Performance requirements established by certain standards organizations may typically be 10,000 insertion and withdrawal cycles. It would be desirable to have a connector which met these requirements and yet had a simple and reliable design.

SUMMARY OF THE INVENTION

In order to provide a durable, reliable electrical connector at reasonable cost, the present invention provides a flexible circuit connector for connecting one electronic device to another. The connector includes a flexible circuit sheet having electrically conductive traces which are electrically connected to one electronic device and lead to an array of electrically conductive pads which extend across the width of the flexible circuit sheet. The connector further includes a connector housing having two spaced apart, substantially parallel side walls connected by a front wall which includes a row of holes adjacent to at least one of the two side walls. The holes are configured to receive a row of electrically conductive pins which are electrically connected to another electronic device. A unitary, locally deformable, biasing member is provided within the connector housing. The conductive pads on the flexible circuit sheet are positioned in the connector housing between the biasing member and at least one of the side walls so that the pads are forced by the biasing member into electrical contact with the pins when they are inserted into the holes in the front wall.

The flexible circuit connector of the present invention can also include a second array of conductive pads on the flexible circuit sheet. The front wall of the connector housing includes a second row of holes adjacent to the other side wall to receive a second row of pins from the other device. Each of the two arrays of conductive pads is placed between the biasing member and one of the side walls so that the biasing member forces both arrays of conductive pads into electrical contact with the two rows of pins.

In one embodiment of the present invention, the flexible circuit sheet is wrapped around the biasing member into a U-shape so that the two arrays of conductive pads are positioned adjacent opposite sides of the biasing member. The flexible circuit connector can also include a stiffener within the biasing member for stiffening the flexible circuit sheet. The biasing member can be a pressure sensitive adhesive, such as an acrylate adhesive foam. One of the electronic devices can be an integrated circuit chip, such as a memory chip.

The present invention also includes an integrated circuit card, such as a memory card, having a flexible circuit sheet as described above secured to a card frame. The card also includes a connector housing and biasing member as described above.

BRIEF DESCRIPTION OF THE DRAWING

The novel features and advantages of the present invention will become more apparent upon consideration of the following detailed description which refers to the accompanying figures, wherein.

DETAILED DESCRIPTION

Figure 1:
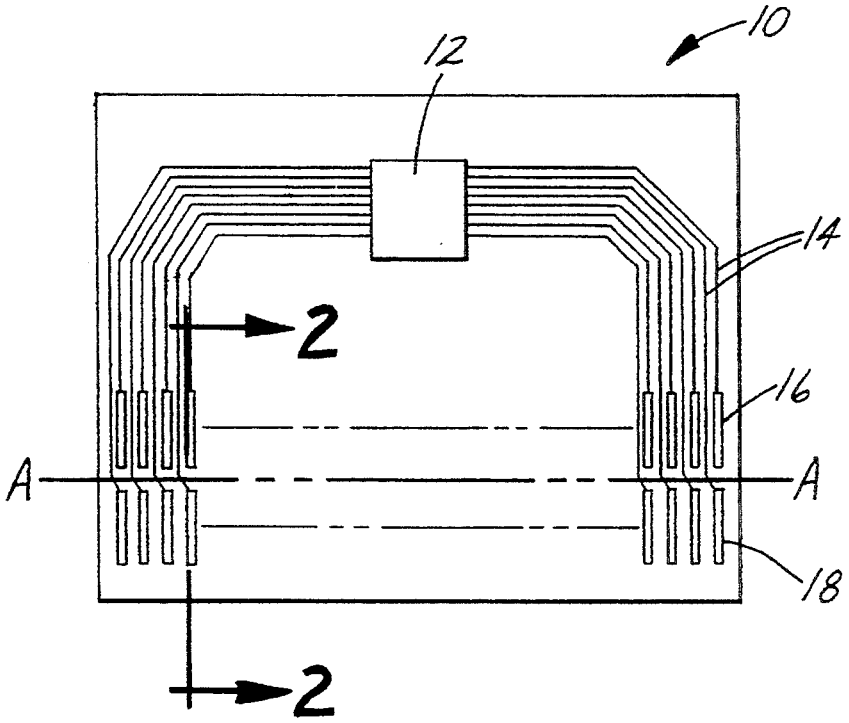
FIG. 1 is a plan view of a flexible circuit sheet according to one embodiment of the present invention.

A flexible circuit sheet 10 is shown in FIG. 1. A plurality of electrically conductive traces 14 are provided on the flexible circuit 10. The traces 14 lead from a first electronic device 12 to first and second arrays of electrically conductive pads 16 and 18.

The first electronic device 12 can be any electronic device, such as one or more integrated circuit (IC) chips, e.g., a memory chip, mounted on the flexible circuit 10, as shown in FIG. 1. In the alternative, the first electronic device 12 can be a larger device that is not mounted on the flexible circuit 10, such as a printed circuit board or a liquid crystal display (LCD).

The first and second arrays of conductive pads 16 and 18 are positioned on either side of straight line A—A, as shown in FIG. 1. Half of the traces 14 lead to the first array of conductive pads 16 and the other half lead to the second array of conductive pads 18. Sixty-eight traces 14 are shown in FIG. 1 leading to thirty-four conductive pads 16 and thirty-four conductive pads 18. These numbers of traces and pads conform to one of the existing standards. However, the number of traces and pads can be increased or decreased as desired.

The first and second arrays of pads 16 and 18 are shown in FIG. 1 as being in two rows. However, each array need not be formed in a single row, so long as the two arrays are separated.

Figure 2:
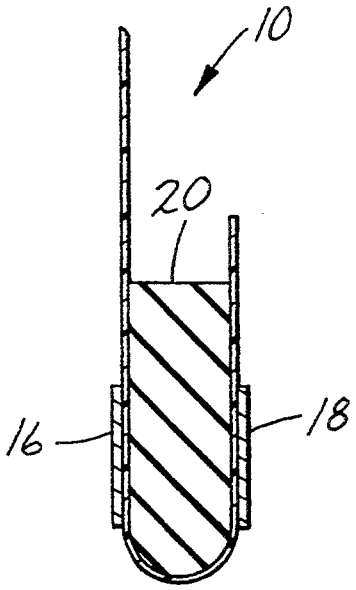
FIG. 2 is a cross-sectional side view taken along the line 2—2 of the flexible circuit sheet shown in FIG. 1 which has been folded along the line A—A.

A cross-sectional side view of a U-shaped flexible circuit 10 is shown in FIG. 2. The U-shaped flexible circuit 10 is formed by bending the flexible circuit along the line A—A and placing a unitary, locally deformable, biasing member 20 between the folded flexible circuit. The flexible circuit 10 should be bent so that the two arrays of conductive pads 16 and 18 are on opposite sides of the biasing member 20.

Preferred materials for the unitary, locally deformable, biasing member 20 include foams, sponges, and rubbers, plastic or metal mesh, such as steel wool, and liquid or gas-filled elastomeric or non-elastomeric bladders. The biasing member 20 is preferably resilient. More preferably, the biasing member 20 is elastomeric. Materials which are easily deflected under pressure and which have good recovery when the pressure is removed are preferred.

It is preferable that the biasing member 20 adhere to the flexible circuit sheet 10. A thin layer of an appropriate adhesive, such as an acrylate or silicon-based adhesive, can be used if needed to secure the biasing member 20 to the flexible circuit sheet 10. It is desirable to be able to combine the adhesive and the biasing member 20 into a single material, such as an elastomeric adhesive. One preferred elastomeric adhesive is an acrylate adhesive foam, such as very high bond VHB TM acrylate adhesive foam available from 3M Company, St. Paul, Minn. Other foams, sponges, or rubbers can be used, including both filled and untilled versions of very high bond VHB TM acrylate foam from 3M Company, silicon rubber, and Fluorel TM brand fluoroelastomers, also available from 3M Company.

The appropriate thickness of the biasing member 20 should be chosen to ensure that there will be some pressure between the conductive pads 16 and 18 on the flexible circuit 10 and the two rows of header pins 62 and 64 (to be discussed later with reference to FIG. 5). For example, for rows of header pins that are separated by 0.050 inches (1.3 mm), the thickness of the biasing member 20 between the two portions of the flexible circuit 10 is preferably within the range of from about 0.001 to 0.100 inches (0.02 to 2.5 mm), more preferably from about 0.030 to 0.045 inches (0.7 to 1.1 mm), and most preferably about 0.035 inches (0.9 mm).

Figure 3A:
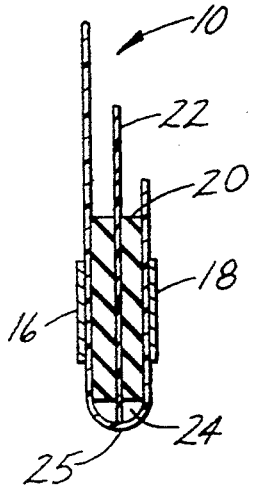
FIG. 3A is a cross-sectional side view of a flexible circuit sheet according to a second embodiment of the present invention.
Figure 3B:
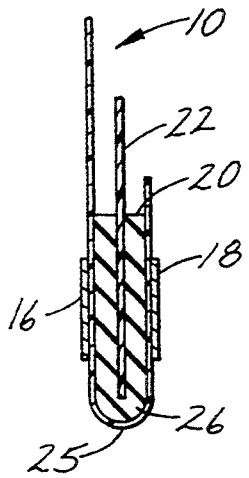
FIG. 3B is a cross-sectional side view of a flexible circuit sheet according to a third embodiment of the present invention.
Figure 3C:
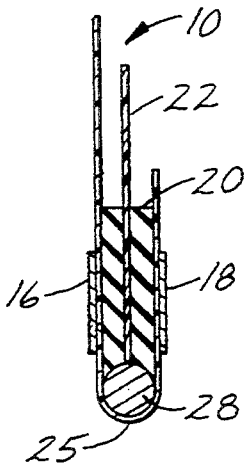
FIG. 3C is a cross-sectional side view of a flexible circuit sheet according to a fourth embodiment of the present invention.

A planar stiffener 22 may be placed between the two portions of the flexible circuit 10 which support the two arrays of conductive pads 16 and 18, as shown in FIGS. 3A–3C. The stiffener 22 provides added stiffness to the folded flexible circuit 10 which decreases the likelihood that the folded flexible circuit will buckle when it is inserted between the two rows of header pins 62 and 64 (to be discussed later with reference to FIG. 5).

The stiffener 22 can extend to the tip 25 of the U-shaped flexible circuit 10, as shown in FIG. 3A. The biasing member 20 can be terminated before the end of the stiffener 22, creating an air pocket 24 at the tip 25 of the U-shaped flexible circuit 10.

In an alternative embodiment the stiffener 22 does not extend all the way to the tip 25 of the U-shaped flexible circuit 10 while the biasing member 20 does, thereby creating a flexible region 26 at the center of the tip, as shown in FIG. 3B. In another embodiment, the flexible circuit 10 is wrapped around a cylindrical member 28, as shown in FIG. 3C. The cylindrical member 28 acts as a bending mandrel to prevent breakage of the electrical traces 14 during the bending of the flexible circuit 10 to form the tip 25. The length of the cylindrical member 28 lies along the width of the flexible circuit 10, which is wrapped around a portion of the circumference of the cylindrical member. The cylindrical member 28 can be a wire or a flexible tube, or it can be pan of the stiffener 22. The diameter of the cylindrical member 28 can be selected to provide the appropriate fit between the header pins 62 and 64 (FIGS. 5 and 6) and the flexible circuit 10.

Figure 4:
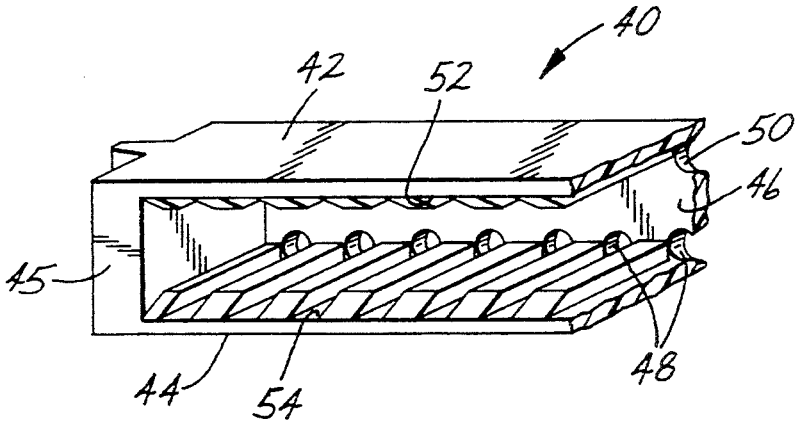
FIG. 4 is a rear perspective view of a connector housing according to one embodiment of the present invention.

A connector housing 40 is shown in FIG. 4. The connector housing 40 has two substantially parallel side walls 42 and 44 which should be longer than the width of the flexible circuit 10. The two side walls 42 and 44 are connected by two substantially parallel shorter walls 45 which should be longer than the thickness of the U-shaped flexible circuit 10. The two side walls 42 and 44 are also connected by a front wall 46. The front wall 46 has a row of through holes 48 adjacent to the side wall 44 and extending along the length of the side wall 44. The front wall 46 has a second row of through holes 50 (see FIG. 5) adjacent to the opposite side wall 42 and extending along the length of the side wall 46.

The connector housing 40 is provided with two sets of parallel channels 52 and 54. The first set of channels 52 is provided in the surface of the wall 42 facing the wall 44. The channels 52 are spaced across the length of the wall 42. Each channel 52 runs from a hole 50 to the opening of the connector housing 40 opposite the front wall 46. Similarly, the second set of channels 54 is provided in the surface of the wall 44 facing the wall 42. The channels 54 are spaced across the length of the wall 44, and each channel 54 runs from a hole 48 to the opening of the connector housing 40 opposite the front wall 46.

Figure 5:
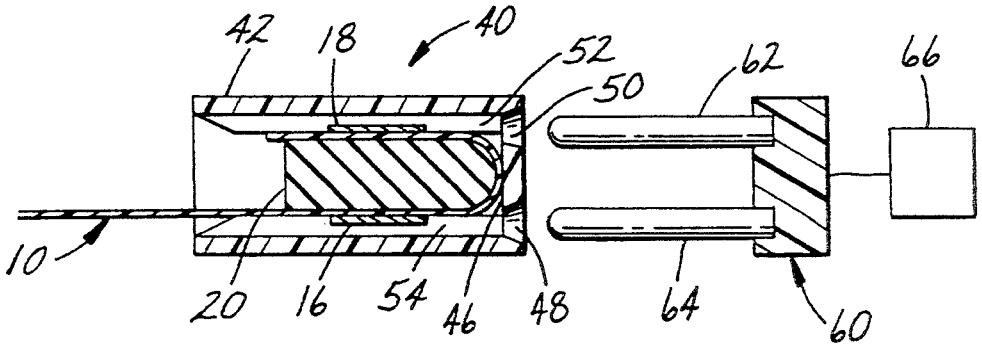
FIG. 5 is a cross-sectional side view of a header and a flexible circuit connector according to one embodiment of the present invention.

The U-shaped flexible circuit 10 is inserted into the connector housing 40 so that the tip 25 of the U-shaped flexible circuit contacts the front wall 46 of the connector housing, as shown in FIG. 5. The width of the flexible circuit 10 will extend substantially across the length of the side walls 42 and 44, thereby filling most of the opening in the connector housing 40 opposite the front wall 46. The flexible circuit 10 should be oriented in the connector housing, 40 such that the conductive pads 16 and 18 are aligned with the channels 52 and 54, respectively. The flexible circuit 10 can be secured to the connector housing 40 by a compression fit, an adhesive, or by mechanically locking the stiffener 22 (if used) to the connector housing.

A header 60 of a second electronic device 66 is shown in cross-section in FIG. 5. The second electronic device 66 can be a printed circuit board, or other electronic circuitry. The header 60 has two rows of electrically conductive pins 62 and 64. The number of pins 62 and 64 should correspond to the number of holes 50 and 48, respectively, and the number of channels, 52 and 54 respectively. Thus, because there are thirty-four conductive pads 16 and thirty-four conductive pads 18, there are preferably thirty-four header pins 62 and thirty-four header pins 64. The pins 62 and 64 can have a circular, elliptical, or rectangular cross-section.

In an alternative embodiment of the present invention, the two arrays of pads 16 and 18 could be a single array of pads where the pads were long enough to extend from one side of the biasing member 20 to the other side. If this arrangement were used with the header 60, redundancy would be provided since two pins (one from row 62 and one from row 64) would contact the same pad.

Figure 6:
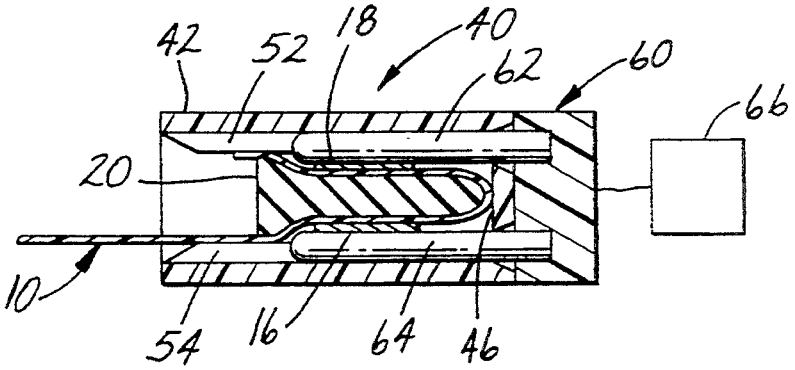
FIG. 6 is a cross-sectional side view of the engagement of the header with the flexible circuit connector shown in FIG. 5.

FIGS. 5 and 6 show cross-sections of the connector housing 40 of FIG. 4. In order to electrically connect the first electronic device 12 with the second electronic device 66 having a header 60, the two rows of header pins 62 and 64 must be inserted through the two rows of holes 50 and 48, respectively, in the connector housing 40. The header pins 62 and 64 then travel down the channels 52 and 54, respectively. As the header pins 62 and 64 travel down the channels 52 and 54, respectively, they are forced toward the biasing member 20 by the side walls 42 and 44, respectively, as shown in FIG. 6. These forces act to locally deform the biasing member 20 in the areas adjacent the header pins 62 and 64. The biasing member 20 responds by forcing the conductive pads 16 and 18 toward the header pins 62 and 64, respectively. The force exerted by the biasing member 20 ensures good electrical contact between the header pins 62 and 64 and the pads 16 and 18, respectively, which in turn ensures good electrical contact between the first electronic device 12 and the second electronic device 66, Because the biasing member 20 is locally deformable, it deforms around the header pins 62 and 64 as they are inserted into the connector housing 40. This forces the flexible circuit sheet 10 to wrap around a portion of the header pins 62 and 64, which creates a broader area of electrical contact between the header pins and the conductive pads 16 and 18 on the flexible circuit sheet.

The use of the unitary, locally deformable, biasing member 20 is particularly advantageous where the spacing between adjacent header pins 62 and 64 is so small that the use of so many conventional stamped metal springs in such a small area is problematic. This can occur when adjacent header pins have a center to center spacing of less than about 4 mm.

It is believed that the biasing member 20 of the present invention provides a pressure against the sides of the header pins 62 and 64 that is relatively constant over the length of the portion of the pins that contacts the conductive pads 16 and 18, respectively. In contrast, it is believed that the use of conventional stamped metal springs to bias the header pins against the conductive pads creates a less constant pressure between the pins and pads along the length of each pin. It is believed that the more constant pressure applied by the locally deformable biasing member 20 of the present invention allows the flexible circuit 10 to be inserted into the header 60 with a minimum of degradation to the surface of the flexible circuit. This decreases the wear rate of the flexible circuit 10 and thus prolongs the useful life of the flexible circuit connector.

As the header pins 62 and 64 travel down the channels 52 and 54, respectively, during insertion of the header 60 into the connector housing 40, the pressure required to move the header with respect to the connector housing increases so that the header pins will remain in electrical contact with the conductive pads 16 and 18 after insertion. The "feel" of the insertion can be varied by changing the shape of the channels 52 and 54 or by selecting different materials or thicknesses for the flexible circuit sheet 10, the stiffener 22, and the biasing member 20. In addition, the thickness of the biasing member 20 can be tapered toward the tip 25 of the U-shape and the hole 48 and 50 can be shaped to facilitate insertion of the flexible circuit 10 into the header 60.

In an alternative embodiment of the present invention (not shown), the header 60 could include three or more rows of header pins. In that case, additional biasing members 20 could be used.

Figure 7:
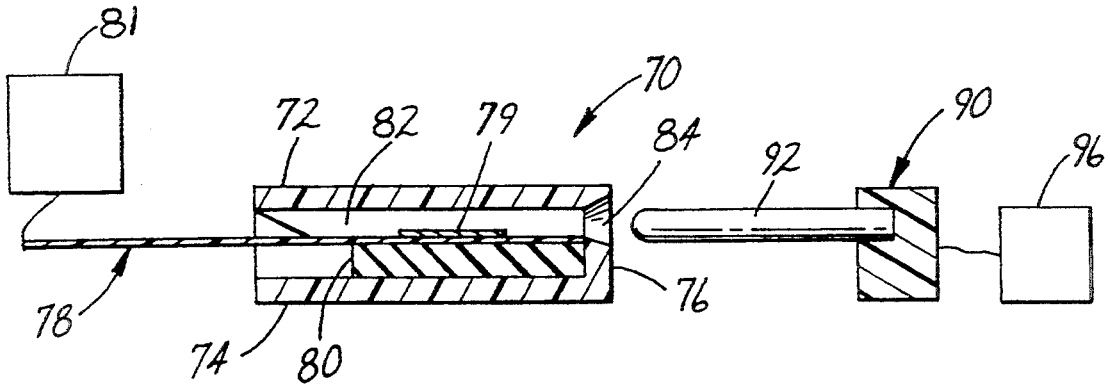
FIG. 7 is a cross-sectional side view of a header and a flexible circuit connector according to an alternative embodiment of the present invention.

Another embodiment of the present invention is shown in FIG. 7. A flexible circuit sheet 78 is electrically connected to a first electronic device 81. The flexible circuit 78 is not U-shaped and has only one array of electrically conductive pads 79 spanning the width of the flexible circuit. A unitary, locally deformable, biasing member 80 is provided on the flexible circuit 78 on the side opposite the pads 79.

The biasing member 80, the conductive pads 79, and a portion of the flexible circuit 78 are contained within the connector housing 70. The connector housing 70 has two spaced, parallel side walls 72 and 74, and two spaced, parallel walls (not shown) which connect the two side walls 72 and 74. The connector housing 70 also has a front wall 76 which connects the two side walls 72 and 74 (as well as the other two parallel walls).

A row of holes 84 is provided in the front wall 76 adjacent the wall 72 and extending along the length of the wall 72. A single set of channels 82 are provided on the surface of the wall 72 facing the wall 74. The channels 82 are spaced along the length of the wall 72. Each channel 82 runs from a hole 84 to the opening in the connector housing 70 opposite the front wall 76. The flexible circuit 78 should be oriented in the connector housing 70 so that the conductive pads 79 are aligned with the channels 82.

A header 90 of a second electronic device 96 is also shown in FIG. 7. The header 90 has only a single row of electronically conductive pins 92. The number of pins 92 should correspond to the number of holes 84, e.g., thirty-four.

As the header pins 92 travel down the channels 82, they are forced toward the biasing member 80 by the side wall 72. The biasing member 80 responds by forcing the conductive pads 79 toward the header pins 92, thereby ensuring good electrical contact between the header pins and the conductive pad, and therefore good electrical contact between the first electronic device 81 and the second electronic device 96. Of course, the header 90 having the single row of pins 92 could also be inserted into the connector housing 40 shown in FIG. 5. In that case, the header pins 92 would pass through either the row of holes 48 or the row of holes 50.

Figure 8:
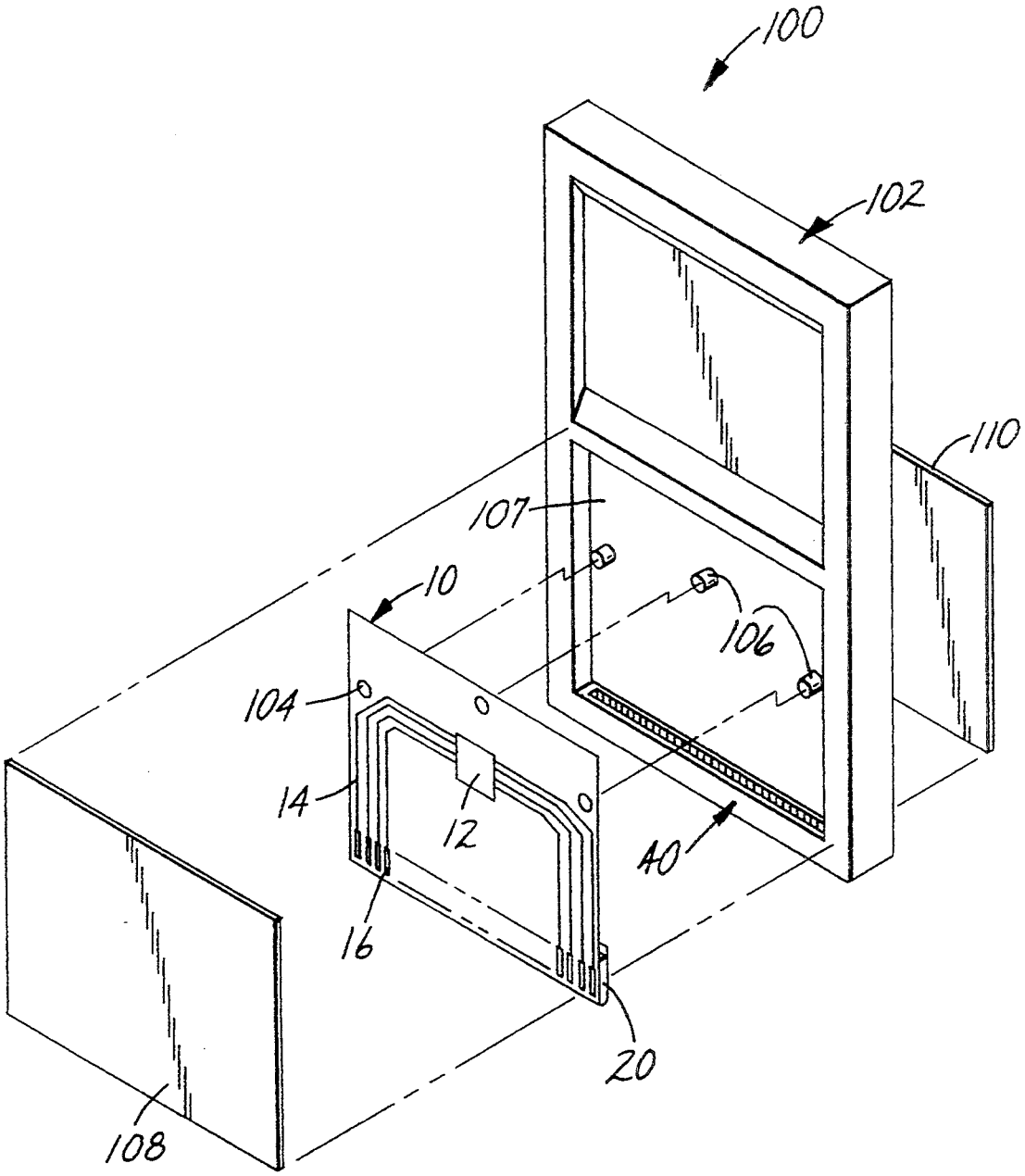
FIG. 8 is an exploded view of an integrated circuit (IC) card according to the present invention.

An integrated circuit (IC) card 100 according to the present invention is shown in FIG. 8. The IC card 100 can be a personal computer (PC) card, such as an input-/output (I/O) card or a memory card, or it can be a Smart card. The IC card 100 includes the flexible circuit 10 having the conductive pads 16 and 18 as shown in FIG. 2. The first electronic device 12 is an IC chip. The U-shaped flexible circuit 10 is mounted into the connector housing 40, as shown in FIG. 5.

As shown in FIG. 8, a card frame has a floor 107 from which posts 106 protrude. The flexible circuit 10 has holes 104 Which correspond to the posts 106. The flexible circuit 10 can be mounted on the floor 107 of the card frame 102 by pressing the flexible circuit against the floor so that the flexible circuit is secured to the floor by the interference fit between the holes 104 and the posts 106. The posts 106 can be made slightly larger than the holes 104 to ensure a snug fit. The posts 106 can be heat staked or sonic welded if necessary.

The array of posts 106 should be positioned on the floor 107 of the card frame 102 so that the frame's relationship with respect to the connector housing 40 is highly controlled by tight tolerance of these two parts. The holes 104 on the flexible circuit 10 should be similarly controlled with respect to the conductive pads 16 and 18 on the flexible circuit. Controlling these relationships allows registration of the conductive pads 16 and 18 of the flexible circuit 10 with respect to the channels 52 and 54 in the connector housing 40.

Another method of controlling the relationship between the pads 16 and 18 and the channels 52 and 54 is to control the width of the flexible circuit 10 and the length of the opening in the connector housing 40 opposite the front wall 46 so that there is a slight interference fit between them. This condition will require that the fit between the posts 106 of the card frame 102 and the holes 104 of the flexible circuit 10 be a loose fit rather than a press fit. Heat staking, sonic welding, or another locking technique is required to affix the flexible circuit 10 to the card frame 102 if hole-post interference fits are not used.

A front cover 108 and a back cover 110 can then be'secured to the card frame 102 by an adhesive or a snap-on feature integrally molded into the card frame.

The present invention will now be described with reference to the following non-limiting example.

EXAMPLE

A U-shaped flexible circuit 10 as shown in FIG. 3A was constructed using 0.001 inch (25 μm) thick polyimide film having 700 μm (18 μm) thick rolled copper. The covercoat metallurgy used was 70 μm (2 μm) nickel, 3 μm (76 nm) palladium, 30 μm (0.8 μm) palladium-nickel from AT&T, and 3 μm (76 nm) gold to form the pattern shown in FIG. 1.

0.020 inches (0.5 mm) of very high bond VHB TM 3M acrylate adhesive foam rubber was applied to both sides of the stiffener 22 to form the biasing member 20. The stiffener 22 was a sheet of 0.005 inch (0.13 mm) thick Valox TM polyester from General Electric Co., Pittsfield, Mass. The side of the flexible circuit 10 opposite the traces 14 was then aligned on the biasing member 20. The flexible circuit 10 was then bent 180° to form a 0.4 mm radius at the tip 25, thereby allowing the shorter end of the flexible circuit 10 (i.e., having the conductive pads 18) to adhere to the biasing member 20. Care was taken to avoid cracking the conductive traces at the bend.

A connector housing similar to the connector housing 40 was constructed from the body of an AMP 68 socket connector (AMP Inc., Harrisburg, Pa., part number 175651-2). First; all of the spring sockets were removed. Then a 0.040 inch (1 mm) slot was milled down the centerline of the connector housing leaving 0.030 inches (0.8 mm) of plastic on the face of the connector. The flexible circuit sheet 10 bent around the biasing member 20 was then inserted into the connector housing 40 and the channels 52 and 54 were aligned with the 0.030 inch (0.8 mm) wide conductive pads 16 and 18, respectively. The U-shaped flex circuit sheet 10 was then clamped onto the connector housing 40.

Wear tests were performed on this construction according to Personal Computer Memory Card International Association (PCMCIA) standard 2.0. A Fujitsu header 60 (part number FCN-565PO68-G/C-V4) having sixty-eight header pins 62 and 64 was used. The electrical contact resistance averaged 15.1 mΩ initially, and, after 10,000 insertions and withdrawals, none of the contacts had increased by more than 20 mΩ in resistance. This complies with PCMCIA standard 2.0 which requires the initial electrical contact resistance to be below 40 mΩ, and requires that the increase of the final resistance over the initial resistance be no more than 20 mΩ.

The insertion and withdrawal forces at 1 inch/minute (2.5 cm/min.) initially averaged 8.4 lb (3.8 Kg) and 2.3 lb (1.0 Kg), respectively, and after 10,000 insertion and withdrawal cycles, they averaged 8.6 lb (3.9 Kg) and 2.2 lb (1.0 Kg), respectively. These measurements were also well within PCMCIA standard 2.0 which requires that the insertion force not exceed 8.8 lb (4.0 Kg) and that the withdrawal force not fall below 1.5 lb (0.7 Kg). The electrical contacts also met the PCMCIA standard 2.0 after a 250 hour environmental exposure at 85° C.

What is claimed is:

1. A non-zero insertion force flexible circuit connector for connecting a first electronic device to a second electronic device, the connector comprising:

a flexible circuit sheet having a plurality of electrically conductive traces which are electrically connected to a first electronic device and lead to an array of electrically conductive pads extending across the width of the sheet;

a connector housing including two spaced, substantially parallel side walls and a front wall substantially perpendicular to and connecting the two side walls, wherein the front wall includes a row of holes adjacent to at least one of the two side walls for receiving at least one row of electrically conductive pins electrically connected to a second electronic device; and a unitary, locally deformable, biasing member disposed within the connector housing wherein the conductive pads on the flexible circuit sheet are disposed within the housing between the biasing member and at least one of the side walls so that the pads will be forced into electrical contact with the pins by the biasing member as the pins are inserted in the holes in the front wall of the connector housing, and wherein as the pins are further inserted into the connector housing, the biasing member is deformed by the pins.

2. The connector of claim 1, wherein the second electronic device has a second row of pins parallel to the first row, wherein the flexible circuit sheet further includes a second array of electrically conductive pads, wherein the front wall further includes a second row of holes adjacent to the other side wall for receiving the second row of pins, and wherein each of the first and second arrays of conductive pads is disposed between the biasing member and one of the side walls.

3. The connector of claim 2, wherein the flexible circuit sheet is wrapped around the biasing member into a U-shape so that the first array of conductive pads is disposed on one side of the biasing member and faces one of the side walls, and the second array of conductive pads is disposed adjacent the opposite side of the biasing member and faces the other side wall.

4. The connector of claim 2, further including a planar stiffener within the biasing member, wherein the stiffener within the biasing member is substantially parallel to the side walls.

5. The connector of claim 4, wherein the flexible circuit sheet is wrapped around the biasing member into a U-shape so that the first array of conductive pads is disposed on one side of the biasing member and faces one of the side walls, and the second array of conductive pads is disposed adjacent the opposite side of the biasing member and faces the other side wall.

6. The connector of claim 4, wherein the stiffener extends to the bottom of the U-shape, but the biasing member does not.

7. The connector of claim 4, wherein the biasing member extends to the bottom of the U-shape, but the stiffener does not.

8. The connector of claim 4, further including a cylindrical member at the bottom of the U-shape, wherein the bottom of the U-shape is formed by a portion of the circumference of the cylindrical member.

9. The connector of claim 1, wherein the biasing member is resilient.

10. The connector of claim 9, wherein the biasing member is elastomeric.

11. The connector of claim 10, wherein the biasing member is a pressure sensitive adhesive.

12. The connector of claim 11, wherein the pressure sensitive adhesive is an acrylate adhesive foam.

13. The connector of claim 11, wherein the adhesive has a thickness perpendicular to the side walls of less than about 1 min.

14. The connector of claim 11, wherein the adhesive has a thickness perpendicular to the side walls of less than about 0.5 mm.

15. The connector of claim 1, further comprising the first electronic device, and wherein the first device is an integrated circuit chip.

16. The connector of claim 15, wherein the integrated circuit chip is a memory chip.

17. The connector of claim 1, further comprising the first electronic device, and wherein the first device is a printed circuit board.

18. The connector of claim 1, wherein at least one of the side walls includes a plurality of channels and wherein the channels are aligned with the holes in the front wall, whereby the pins travel down the channels as they are inserted into the holes.

19. The connector of claim 1, wherein the biasing member is tapered toward the end adjacent the front wall of the connector housing.

20. The connector of claim 1, wherein each conductive pad has a length parallel to the length of the flexible circuit sheet, and wherein the biasing member provides a pressure between the conductive pads and the pins that is relatively constant over the length of the portions of the conductive pads that contact the pins.

21. An integrated circuit card, comprising:

a card frame;

a flexible circuit sheet secured to the frame, wherein the sheet has a plurality of electrically conductive traces that lead to an array of electrically conductive pads extending across the width of the sheet;

an integrated circuit chip, wherein the chip is mounted on the flexible circuit sheet and is electrically connected to the conductive traces on the sheet;

a connector housing including two spaced, substantially parallel side walls and a front wall substantially perpendicular to and connecting the two side walls, wherein the front wall includes a row of holes adjacent to at least one of the two side walls for receiving at least one row of electrically conductive pins electrically connected to an electronic device; and a unitary, locally deformable, biasing member disposed within the connector housing, wherein the conductive pads on the flexible circuit sheet are disposed within the housing between the biasing member and at least one of the side walls so that the pads will be forced into electrical contact with the pins by the biasing member as the pins are inserted in the holes in the front wall of the connector housing, and wherein as the pins are further inserted into the connector housing, the biasing member is deformed by the pins.

22. The card of claim 21, wherein the electronic device has a second row of pins parallel to the first row, wherein the flexible circuit sheet further includes a second array of electrically conductive pads, wherein the front wall further includes a second row of holes adjacent to the other side wall for receiving the second row of pins, and wherein each of the first and second arrays of conductive pads is disposed between the biasing member and one of the side walls.

23. The card of claim 22, further including a planar stiffener within the biasing member, wherein the stiffener within the biasing member is substantially parallel to the side walls.

24. The card of claim 22, wherein the flexible circuit sheet is wrapped around the biasing member into a U-shape so that the first array of conductive pads is disposed on one side of the biasing member and faces one of the side walls, and the second array of conductive pads is disposed adjacent the opposite side of the biasing member and faces the other side wall.

25. The card of claim 22, wherein the card is a memory card, and wherein the chip is a memory chip.

26. The card of claim 21, wherein the biasing member is resilient.

27. The card of claim 26, wherein the biasing member is elastomeric.

28. The card of claim 27, wherein the biasing member is a pressure sensitive adhesive.

29. The card of claim 21, wherein each conductive pad has a length parallel to the length of the flexible circuit sheet, and wherein the biasing member provides a pressure between the conductive pads and the pins that is relatively constant over the length of the portions of the conductive pads that contact the pins.

30. A non-zero insertion force flexible circuit connector for connecting a first electronic device to a second electronic device, the connector comprising:

a flexible circuit sheet having a plurality of electrically conductive traces which are electrically connected to a first electronic device and lead to an array of electrically conductive pads extending across the width of the sheet, the length of the pads being parallel to the length of the sheet;

a connector housing including two spaced, substantially parallel side walls and a front wall substantially perpendicular to and connecting the two side walls, wherein the from wall includes a row of holes adjacent to at least one of the two side walls for receiving at least one row of electrically conductive pins electrically connected to a second electronic device; and a unitary, locally deformable, biasing member disposed within the connector housing wherein the conductive pads on the flexible circuit sheet are disposed within the housing between the biasing member and at least one of the side walls so that the pads will be forced into electrical contact with the pins by the biasing member as the pins are inserted in the holes in the from wall of the connector housing, wherein as the pins are further inserted into the connector housing the biasing member is deformed by the pins, and wherein the biasing member provides a pressure between the conductive pads and pins that is relatively constant over the length of the portions of the pads that contact the pins.

31. An integrated circuit card, comprising:

a card frame;

a flexible circuit sheet secured to the frame, wherein the sheet has a plurality of electrically conductive traces that lead to an array of electrically conductive pads extending across the width of the sheet, the length of the pads being parallel to the length of the sheet;

an integrated circuit chip, wherein the chip is mounted on the flexible circuit sheet and is electrically connected to the conductive traces on the sheet;

a connector housing including two spaced, substantially parallel side walls and a front wall substantially perpendicular to and connecting the two side walls, wherein the front wall includes a row of holes adjacent to at least one of the two side walls for receiving at least one row of electrically conductive pins electrically connected to an electronic device; and a unitary, locally deformable, biasing member disposed within the connector housing, wherein the conductive pads on the flexible circuit sheet are disposed within the housing between the biasing member and at least one of the side walls so that the pads will be forced into electrical contact with the pins by the biasing member as the pins are inserted in the holes in the front wall of the connector housing, wherein as the pins are further inserted into the connector housing, the biasing member is deformed by the pins, and wherein the biasing member provides a pressure between the conductive pads and pins that is relatively constant over the length of the portions of the pads that contact the pins.

* * * * *

UNITED STATES PATENT AND TRADEMARK OFFICE

CERTIFICATE OF CORRECTION

PATENT NO. : 5,433,632

DATED : July 18, 1995

INVENTOR(S) : Thomas Cherney, Rolf Biermath

It is certified that error appears in the above-indentified patent and that said Letters Patent is hereby corrected as shown below:

In the Abstract, line 13, "array" should read –arrays–.

Column 3, line 62, "untilled" should read –unfilled–.

Column 4, line 36, "pan" should read –part–.

Column 7, line 19, "Which" should read –which–.

Column 7, line 47, "frame-102" should read –frame 102–.

Column 7, line 50, "be'secured" should read –be secured–.

Column 7, line 58, "700 μm" should read –700 μin–.

Column 7, line 59, "70 μm" should read –70 μin–.

Column 7, line 60, "3 μm" should read –3 μin–.

UNITED STATES PATENT AND TRADEMARK OFFICE

CERTIFICATE OF CORRECTION

PATENT NO. : 5,433,632

DATED : July 18, 1995

INVENTOR(S) : Thomas Cherney, Rolf Biermath

It is certified that error appears in the above-indentified patent and that said Letters Patent is hereby corrected as shown below:

Column 7, line 60, "30 μm" should read –30 μin–.

Column 7, line 61, "3 μm" should read –3 μin–.

Column 8, line 11, "First;" should read –First,–.

Column 8, line 62, "housing" should read –housing,–.

Column 9, line 52, "1 min" should read –1 mm–.

Column 11, line 17, "from" should read –front–.

Column 11, line 24, "housing" should read –housing,–.

Column 11, line 30, "from" should read –front–.

Signed and Sealed this

Sixteenth Day of January, 1996

Bruce Lehman

*Attest:*

BRUCE LEHMAN

*Attesting Officer*

*Commissioner of Patents and Trademarks*